United States Patent [19]

Land e

[11] Patent Number: 4,826,503

[45] Date of Patent: May 2, 1989

[54] PROCESS FOR AFTERTREATING CELLULOSIC MATERIAL DYED WITH DYES CONTAINING ACID SULFO GROUPS WITH SALT SOLUTION TO IMPROVE WET FASTNESS AND TEAR STRENGTH

[75] Inventor: Jean-François Land e, Riedisheim, France

[73] Assignee: Ciba-Geigy Corporation, Ardsley, N.Y.

[21] Appl. No.: 917,348

[22] Filed: Oct. 9, 1986

[30] Foreign Application Priority Data

Oct. 14, 1985 [CH] Switzerland ..... 4419/85

[51] Int. Cl.[4] ..... D06P 3/60; D06P 5/02

[52] U.S. Cl. ..... 8/543; 8/529; 8/531; 8/532; 8/549; 8/618; 8/676; 8/680; 8/918

[58] Field of Search ..... 8/680, 543, 549, 594

[56] References Cited

U.S. PATENT DOCUMENTS

| | | | |
|---|---|---|---|
| 3,122,417 | 2/1964 | Blaser et al. | 252/94 |
| 3,738,800 | 6/1973 | Mudrak et al. | 8/532 |
| 4,515,596 | 5/1985 | Berendt et al. | 8/107 |
| 4,645,510 | 2/1987 | Hasler et al. | 8/400 |
| 4,648,883 | 3/1987 | Podder | 8/680 |

FOREIGN PATENT DOCUMENTS

| | | |
|---|---|---|
| 2906138 | 9/1980 | Fed. Rep. of Germany . |
| 3100836 | 11/1981 | Fed. Rep. of Germany . |
| 1428379 | 3/1976 | United Kingdom . |
| 2007253 | 5/1979 | United Kingdom . |
| 1588344 | 4/1981 | United Kingdom . |

*Primary Examiner*—A. Lionel Clingman

*Attorney, Agent, or Firm*—Wenderoth, Lind & Ponack

[57] ABSTRACT

The invention relates to a process for aftertreating cellulosic material which has been dyed with reactive or direct dyes and subsequently treated in an acid bath. The aftertreatment with a solution of an alkali metal salt or alkaline earth metal salt enhances the wetfastness properties and the tear resistance of the cellulosic material.

15 Claims, No Drawings

PROCESS FOR AFTERTREATING CELLULOSIC MATERIAL DYED WITH DYES CONTAINING ACID SULFO GROUPS WITH SALT SOLUTION TO IMPROVE WET FASTNESS AND TEAR STRENGTH

The present invention relates to a process for aftertreating cellulosic material dyed with dyes containing sulfo groups.

Cellulosic material is normally dyed with anionic direct or reactive dyes which contain sulfo groups. If dyeing and the subsequent treatment steps, or at least the last step before drying, are carried out in the neutral or basic range, then the wetfastness properties come up to expectations and the tear resistance of the cellulosic material is not impaired.

After it has been dyed, the cellulosic material is, however, on occasion additionally rinsed with deionised water and treated in a bath having a pH below 7, for example when rinsing with industrial water which is acidic, or if an aftertreatment at acid pH values or a dyeing of any adjacent fabric at acid pH values is carried out subsequently. In the course of the subsequent heat treatment, e.g. drying, a deterioration of the wetfastness properties of the dyeing and/or decrease in the tear resistance of the cellulosic material then often occurs.

It has now been found that these shortcomings can be avoided by subjecting the dyed material, before dying, to an aftertreatment in which the sulfo groups of the dyes, which are in the form of the free acid, are converted into the salt form.

Accordingly, the present invention provides a process for aftertreating cellulosic material which has been dyed with dyes which contain sulfo groups and which has been treated during or after dyeing at an acid pH value, which process comprises subjecting said dyed material, before drying, to an aftertreatment with an aqueous solution of an alkali metal salt or alkaline earth metal salt.

The aftertreatment preferably comprises rinsing the dyed cellulosic material with an aqueous liquor that contains a neutral or weakly basic alkali metal salt or alkaline earth metal salt of an inorganic or organic acid.

These salts are in particular water-soluble salts, for example the lithium, sodium, potassium, magnesium, calcium or barium salts of monovalent or polyvalent inorganic or organic acids such as hydrochloric acid, hydrobromic acid, hydrofluoric acid, nitric acid, sulfuric acid, phosphoric acid, carbonic acid, formic acid or acetic acid. Examples of such suitable metal salts are: sodium nitrate, potassium nitrate, calcium nitrate, magnesium nitrate, sodium chloride, potassium chloride, calcium chloride, magnesium chloride, calcium acetate, sodium and potassium monophosphate, sodium, potassium and magnesium sulfate as well as sodium or potassium bicarbonate.

It is preferred to use a sodium, potassium or calcium salt of hydrochloric acid, sulfuric acid or acetic acid. Sodium or potassium chloride or sodium or potassium sulfate are especially preferred.

These salts are preferably employed in the form of aqueous solutions containing 0.1 to 10% by weight, preferably 0.5 to 5% by weight, of salt.

The dyed cellulosic material is conveniently rinsed immediately before drying with the liquor containing the alkali metal salt or alkaline earth metal salt, for example in a liquor to goods ratio of 1:5 to 1:100, preferably of 1:10 to 1:50, with the temperature generally being in the range from 5° to 50° C., preferably from 10° to 30° C. The treatment time is preferably from about 1 to 60 minutes, most preferably from about 5 to 30 minutes.

Suitable cellulosic material for the process of this invention is textile material made from cellulose fibres or blends thereof with synthetic fibres. Suitable cellulose fibres are those obtained from natural and regenerated cellulose, e.g. hemp, linen, jute, viscose silk, viscose rayon or, preferably, cotton.

Examples of suitable synthetic fibres are: fibre materials made from synthetic polyamide, such as condensates of hexamethylenediamine and adipic acid (polyamide 6,6) or sebacic acid (polyamide 6,10), and also co-condensates of e.g. hexamethylenediamine, adipic acid and ε-caprolactam (polyamide 6, 6/6), as well as polymerisation products of ε-caprolactam or of ω-aminoundecanoic acid. Polyester material is also suitable, e.g. linear high molecular esters of aromatic polycarboxylic acids with polyfunctional alcohols, for example those of terephthalic acid and ethylene glycol or dimethylol cyclohexane, as well as copolymers of terephthalic acid and isophthalic acid and ethylene glycol.

Finally, cellulose 2 1/2 acetate and cellulose triacetate fibres are also suitable for use as synthetic fibres.

The textile material may be in the form of woven or knitted fabrics or of nonwoven fabrics.

This cellulosic material is first dyed in conventional manner with dyes containing 1 to 6, preferably 2 to 4, sulfo groups.

The dyes may belong to any classes of dyes and are e.g. sulfo group containing dyes of the azomethine, dioxazine, phenazine, stilbene, triphenylmethane, xanthene, thioxanthone, nitroaryl, naphthoquinone or pyrenequinone series, but are preferably anthraquinone, phthalocyanine or formazan dyes and, most preferably, azo dyes.

In the context of this invention, dyes will also be understood as comprising fluorescent whitening agents. Examples of suitable fluorescent whitening agents are those of the following compound classes: stilbenes, coumarins, benzocoumarins, pyrenes, pyrazines, pyrazolines, oxazines, mono- or dibenzoxazolyl or mono- or dibenzimidazolyl compounds, aryltriazole and v-triazole derivatives as well as naphthalimides.

Azo or anthraquinone dyes contianing 2 to 4 sulfo groups are especially suitable.

The advantages of the process of this invention, especially the improved wetfastness properties, are particularly evident when aftertreating dyeings obtained with reactive dyes.

The dyes contain at least one reactive group, i.e. a group which reacts with the textile material under the dyeing conditions to form a covalent bond. Possible reactive groups are e.g.: aliphatic reactive radicals such as the acryloyl, vinylsulfonyl, β-sulfatoethylaminosulfonyl, haloacryloyl, halopropionyl or haloacetyl radicals, wehre halogen is fluorine or, preferably, bromine or chlorine, or heterocyclic reactive radicals such as monochlorotriazinyl, dichlorotriazinyl, dichloroquinoxazinyl, di- or trichloropyrimidinyl, difluorochloropyrimidinyl, difluorotriazinyl and fluorotriazinyl radicals.

The aftertreatment of this invention is especially advantageous when applied to dyeings obtained with reactive dyes of the triazinyl, vinylsulfonyl or pyrimidine series.

Dyeing with reactive dyes is normally carried out in alkaline medium, but is often followed by a further treatment which requires an acid pH value, so that the process of this invention is also advantageous when dyeing with such dyes.

Subsequent to the aftertreatment of this invention, the cellulosic material may be additionally rinsed with water and then dried in conventional manner.

The tear resistance of the dyed cellulosic material obtained by the process of the invention is unchanged compared with that of undyed cellullosic material, and the wetfastness properties of the dyeings are comparable to those of dyeings which have not been treated in an acid bath.

The invention is illustrated by the following Examples, in which parts and percentages are by weight.

EXAMPLE 1

An aqueous padding liquor of the following composition is prepared: 40 g/l of the dye of formula

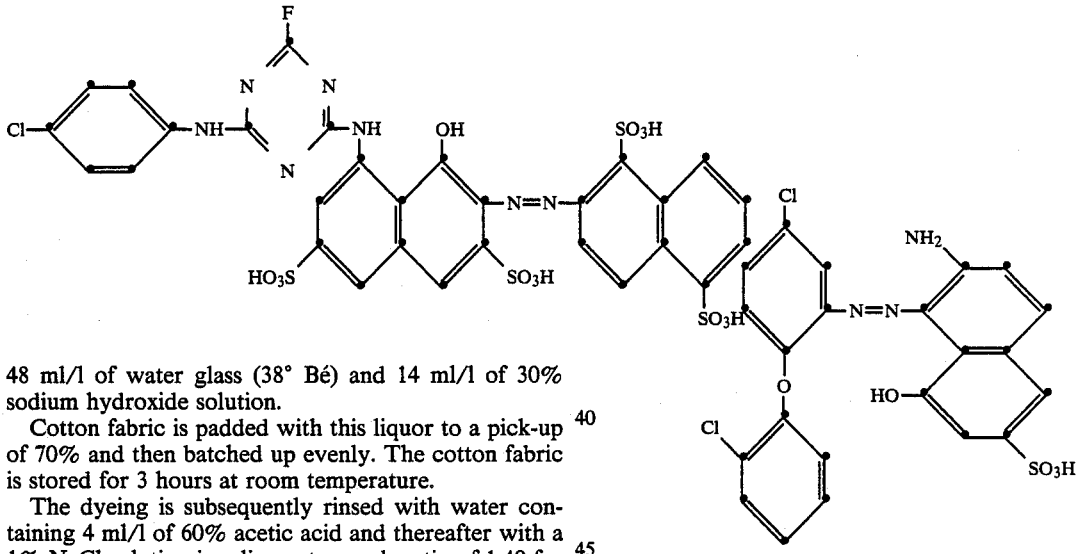

48 ml/l of water glass (38° Bé) and 14 ml/l of 30% sodium hydroxide solution.

Cotton fabric is padded with this liquor to a pick-up of 70% and then batched up evenly. The cotton fabric is stored for 3 hours at room temperature.

The dyeing is subsequently rinsed with water containing 4 ml/l of 60% acetic acid and thereafter with a 1% NaCl solution in a liquor to goods ratio of 1:40 for 10 minutes, and finally dried for 1 minute at 180° C. The red dyeing so obtained has very good wetfastness properties. The tear resistance of the fabric is comparable to that of undyed fabric.

EXAMPLE 2

(Comparison Example)

The procedure of Example 1 is repeated, but omitting rinsing the dyeing with 1% NaCl solution. The wetfastness properties of the dyeing are markedly poorer and the tear resistance of the fabric is substantially diminished.

EXAMPLE 3

2 parts of the reactive dye employed in Example 1 are dissolved in 2000 parts of water. Then 100 parts of a polyamide 6,6/cotton blend (50:50) are put into this dyebath at 40° C. After 5 minutes, 30 g of NaCl are added, followed by the addition after another 40 minutes of 2 g of calcined sodium carbonate and 4 ml of 30% sodium hydroxide solution. Dyeing is carried out for a further 90 minutes at 40° C.

The dyed goods are then rinsed twice with water and put into 2000 parts of an aqueous liquor of 40° C. which has been adjusted with acetic acid to pH 4.5–5.5. After 10 minutes, 0.45 part of the dye of formula and 0.01 part of the dye of formula

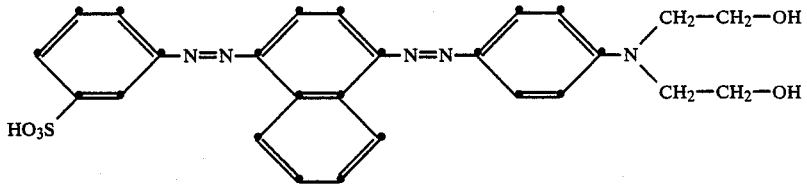

are added and the bath is heated to boiling temperature over 30 minutes. Dyeing is carried out for 45 minutes at this temperature, then the bath is cooled within 15 minutes to a temperature of 60° C. and then the goods are rinsed first with water and then with a 0.5% NaCl solution and once more with water. The dyed goods are dried for 1 minute at 180° C. The blend is dyed in a red tone-in-tone shade and has very good wetfastness properties. The tear resistance is comparable to that of undyed fabric.

Equally good results are obtained by using the same amounts of $Na_2SO_4$, $CaCl_2$ or $NaHCO_3$ instead of NaCl in the penultimate rinsing bath.

If the dyeing is rinsed in the penultimate rinsing bath without the addition of salt, i.e. only with water, then the wetfastness properties of the dyeing are appreciably poorer and the tear resistance of the fabric is substantially diminished.

EXAMPLE 4

An aqueous padding liquor of the following composition is prepared: 40 g/l of the dye of formula

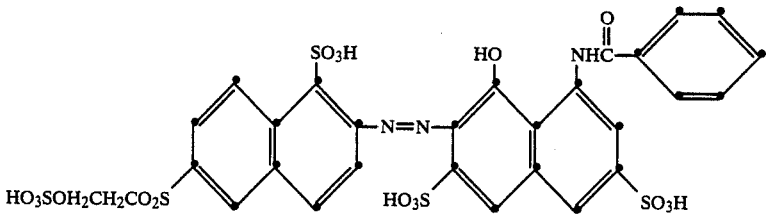

95 ml/l of water glass (38° Bé) and 28 ml/l of 30% sodium hydroxide solution.

Cotton fabric is padded with this liquor to a pick-up of 70% and then batched up evenly. The cotton fabric is stored for 8 hours at room temperature.

The dyeing is subsequently rinsed with water containing 4 ml/l of 60% acetic acid and thereafter with a 1% NaCl solution in a liquor to goods ratio of 1:40 for 10 minutes, and finally dried for 1 minute at 180° C. The red dyeing so obtained has very good wetfastness properties.

EXAMPLE 5

40 parts of the dye of formula

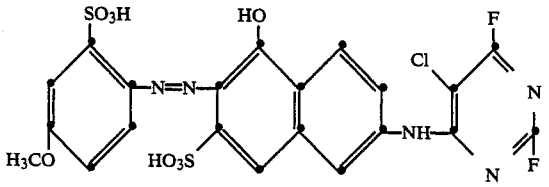

are dissolved in 1000 parts of water. This liquor is then made alkaline by the addition of 14 parts of calcined sodium carbonate and 6 ml of 30% sodium hydroxide solution.

Cotton fabric is padded with this liquor to a pick-up of 70% and then batched up evenly. The cotton fabric is stored for 6 hours at room temperature.

The dyeing is subsequently rinsed with water containing 4 ml/l of 60% acetic acid and thereafter with a 1% NaCl solution in a liquor to goods ratio of 1:40 for 10 minutes, and finally dried for 1 minute at 180° C. The scarlet dyeing so obtained has very good wetfastness properties.

What is claimed is:

1. A process for aftertreating cellulosic material which has been dyed with dyes which contain sulfo groups and which has been rinsed after dyeing with deionised water or treated during or after dyeing at an acid pH value, which process comprises subjecting said dyed material, before drying, to an aftertreatment in a temperature range from 5° to 50° C. with an aqueous solution of an alkali metal salt or alkaline earth metal salt.

2. A process for aftertreating cellulosic material which has been dyed with dyes containing sulfo groups under conditions of dyeing or initial aftertreatment that result in said dyes being present substantially in their acid form, which process comprises subjecting the material before drying to an aftertreatment in a temperature range from 5° to 50° C. with an aqueous solution of an alkali metal salt or an alkaline earth metal salt.

3. A process according to claim 2, wherein said aftertreatment comprises rinsing the dyed cellulosic material with an aqueous liquor which contains a neutral or weakly basic alkali metal salt or alkaline earth metal salt of an inorganic or organic acid.

4. A process according to claim 2, wherein said salt is a sodium, potassium or calcium salt of hydrochloric acid, sulfuric acid or acetic acid.

5. A process according to claim 3, wherein said salt is sodium or potassium chloride or sodium or potassium sulfate.

6. A process according to claim 2, wherein said aftertreatment comprises treating cellulosic material with a salt solution containing 0.1 to 10% by weight of the alkali metal salt or alkaline earth metal salt.

7. A process according to claim 2, wherein the aftertreatment is carried out at a liquor to goods ratio of 1:5 to 1:100.

8. A process according to claim 2, wherein the aftertreatment is carried out for 1 to 60 minutes.

9. A process according to claim 2, for aftertreating cellulosic material which has been dried with a reactive dye.

10. A process according to claim 9 for aftertreating cellulosic material which has been dyed with a reactive dye of the triazine, vinylsulfone or pyrimidine series.

11. A process according to claim 2 for aftertreating cellulosic material which has been dyed with dyes containing sulfo groups, which process comprises rinsing the dyed material with an acidic rinse and then treating the material with an aqueous solution of said metal salt.

12. A process according to claim 6 wherein said salt solution contains 0.5 to 5% by weight of the alkali metal or alkaline earth metal salt.

13. A process according to claim 7 wherein said ratio is 1:10 to 1:50.

14. A process according to claim 12, wherein the temperature range is from 10° to 30° C.

15. A process according to claim 8, wherein the aftertreatment is carried out for 5 to 30 minutes.

* * * * *